US005959263A

United States Patent [19]

Foltz, Jr.

[11] Patent Number: 5,959,263

[45] Date of Patent: Sep. 28, 1999

[54] BYPASS MUFFLER

[75] Inventor: Gilbert H. Foltz, Jr., Mesa, Ariz.

[73] Assignee: Biggs Manufacturing, Inc., Tempe, Ariz.

[21] Appl. No.: 09/074,350

[22] Filed: May 7, 1998

[51] Int. Cl.[6] ..... F01N 1/00

[52] U.S. Cl. ..... 181/254; 181/236; 181/237; 181/265; 181/272

[58] Field of Search ..... 181/236, 237, 181/238, 239, 241, 253, 254, 265, 269, 272

[56] References Cited

U.S. PATENT DOCUMENTS

| | | | |
|---|---|---|---|
| 1,626,908 | 5/1927 | Amstrong | 181/254 |
| 4,779,705 | 10/1988 | Verdin | 181/236 |
| 5,723,827 | 3/1998 | Sasaki et al. | 181/253 |

*Primary Examiner*—Khanh Dang
*Attorney, Agent, or Firm*—Charles E. Cates; Richard G. Harrer

[57] ABSTRACT

This invention relates to an exhaust gas muffler assembly for internal combustion engines which is operable in both a muffled or unmuffled mode. In exterior appearance, the bypass muffler of this invention looks like a conventional muffler having a shell and end caps which enclose the interior components, an inlet for entry of the exhaust gas from the engine, and two outlets for exit of the exhaust gas to atmosphere. A first outlet is preferably positioned opposite to the exhaust gas inlet and connected directly to the inlet by means of a pipe. This pipe is not provided with silencing means. Within the interior of the muffler are silencing means employing a center pipe and an exhaust gas outlet pipe, each of which are provided with silencing means such as apertures in the walls of each pipe. Flow diverting means are removably placed within the first outlet. When the flow diverting means are in place, exhaust gas is diverted through an opening in the side wall of the pipe leading from the exhaust gas inlet to and through the center pipe and finally through the exhaust gas outlet pipe and out the second outlet in a muffled state.

7 Claims, 2 Drawing Sheets

BYPASS MUFFLER

FIELD OF THE INVENTION

The present invention relates to a exhaust gas muffler for internal combustion engines of vehicles, particularly for vehicles where it is desirable to have a muffler which is operable in a muffled or unmuffled mode.

BACKGROUND

It is conventional practice to route the exhaust gases from the exhaust manifold of an internal combustion engine through a catalytic converter, then through a muffler and finally to the tail pipe and to atmosphere. Of course, the purpose of routing the exhaust gases through a muffler is to reduce engine noise. While this is desirable and even necessary for conventional use, that is street use, the back pressure caused by the exhaust gases passing through a muffler results in a loss of efficiency which can adversely affect engine performance. Many high performance engines operate most efficiently when the muffler is removed or bypassed. While this improves engine performance, the result in noise from the engine will likely prohibit use of the vehicle where unrestricted engine noise is not desirable or even prohibited. Therefore it would be very desirable to have a muffler which is operable in both a muffled or unmuffled mode. That is, in a muffled mode the muffler would utilize the silencing means in the muffler which would limit the sound level of exhaust gas noises to a legally permissible level. In the unmuffled mode, the silencing means would be bypassed so that the exhaust gases can be conducted to the atmosphere without any significant resistance from the muffler.

U.S. Pat. No. 1,766,973 (Beck) discloses a two part muffler. A so called "container" is connected to the outer end of an exhaust pipe. This container is basically a straight-through pipe which has a butterfly valve positioned at one end. Opening the butterfly valve permits the exhaust gases to escape directly to the atmosphere without muffling. The system also includes a diagonal pipe which is connected to the central portion of the container and extends for a distance from the body of the container. This pipe contains a number of baffle plates which are designed to muffle the gases that escape from the container through the pipe. Thus, if the driver wants to get the effect of a straight through pipe, the butterfly valve is opened which allows most of the exhaust gas from the engine to pass directly to atmosphere in an unmuffled state. If muffling of the sound is desired, then the butterfly valve is closed, and the gas passes through the pipe which contains baffle plates.

U.S. Pat. No. 1,840,082 (Breer) discloses a muffler in which the exhaust gas may pass directly through the muffler or maybe diverted through chambers in the muffler which deaden the noise of the exhaust gases. The muffler assembly uses a butterfly valve to allow exhaust gases to pass through a muffler in what is basically an unmuffled situation. If the butterfly is closed, some of the exhaust gases then pass through expansion chambers in the muffler and are thereby muffled.

U.S. Pat. No. 3,749,199 (Weber) discloses an exhaust gas muffler which is constructed such that the exhaust gas can be passed through the muffler for silencing or it can bypass the silencing means in the muffler and be exhausted directly to atmosphere with little or no resistance. The muffler system utilizes covers to close off portions of the exhaust system and exhaust gases are then passed through portions of the muffler for silencing. If the vehicle is to be utilized in a race, for example, then the covers are removed from certain of the exhaust pipes and the exhaust gases are conducted directly from the engine to atmosphere.

SUMMARY OF THE INVENTION

This invention relates to an exhaust gas muffler assembly for internal combustion engines which is operable in both a muffled or unmuffled mode. In exterior appearance the bypass muffler of this invention looks like a conventional muffler having a shell and end caps which enclose the interior components, an inlet for entry of the exhaust gas from the engine, and two outlets for exit of the exhaust gas to atmosphere. A first outlet is preferably positioned opposite to the exhaust gas inlet and connected directly to the inlet by means of a pipe. This pipe is not provided with any silencing means. Also mounted within the interior of the muffler are silencing means employing a center pipe and an exhaust gas outlet pipe, each of which provided with silencing means such as apertures in the walls in each pipe. The exhaust gas outlet pipe communicates with a second outlet and allows exhaust gas passing through the various pipes within the interior of the muffler to exit to a tail pipe or to atmosphere in a muffled state. Flow diverting means are removably placed within the first outlet. When the flow diverting means are in place, exhaust gas is diverted through an opening in the side wall of the pipe leading from the exhaust gas inlet to and, through the center pipe and finally through the exhaust gas outlet pipe and out the second outlet. The face of the flow diverting means is angled such that the exhaust gas is more efficiently routed through the muffler components. When such means are removed, virtually all the exhaust gas is conducted directly from the engine through the first exhaust gas outlet and to atmosphere.

DETAILED DESCRIPTION OF PREFERRED EMBODIMENT

Figure 1:
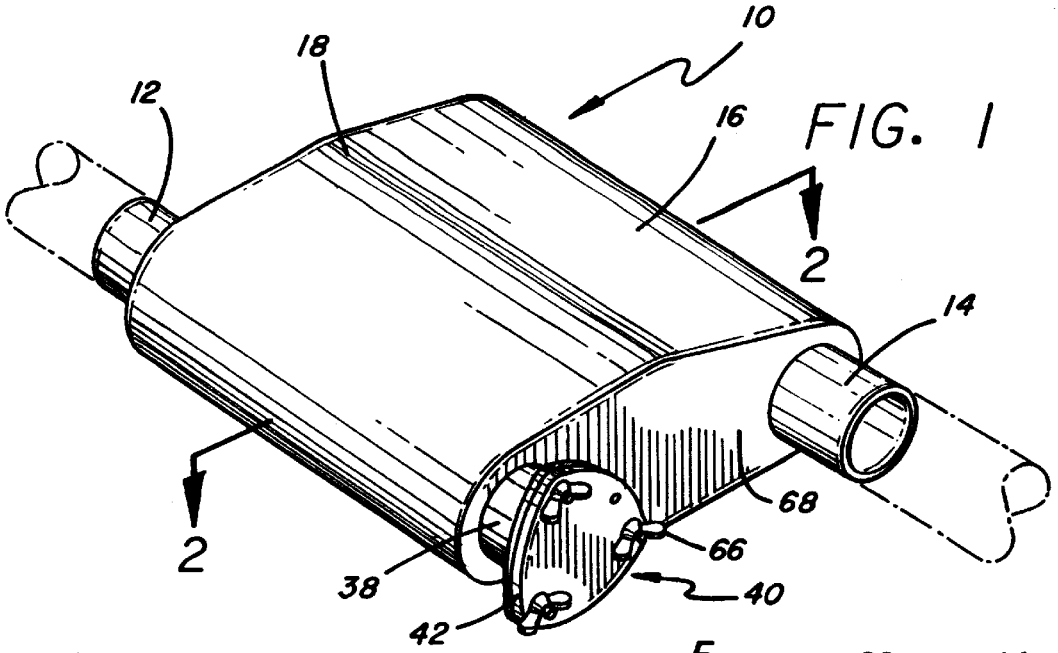
FIG. 1 is a perspective view of the bypass muffler of this invention showing the flow diverting means in place.

Referring to the drawings, FIG. 1 is a perspective view of the bypass muffler of this invention which from external appearances, resembles a conventional muffler. Bypass muffler 10 includes an external shell 16 and endcaps 18 and 68 which together completely surround the interior components of the muffler. As shown, bypass muffler 10 is also provided with inlet 12 for entry of exhaust gas from an engine and two outlets, 38 and 14. Also shown in FIG. 1 is flow diverter 40 which is mounted within outlet 38.

Figure 2:
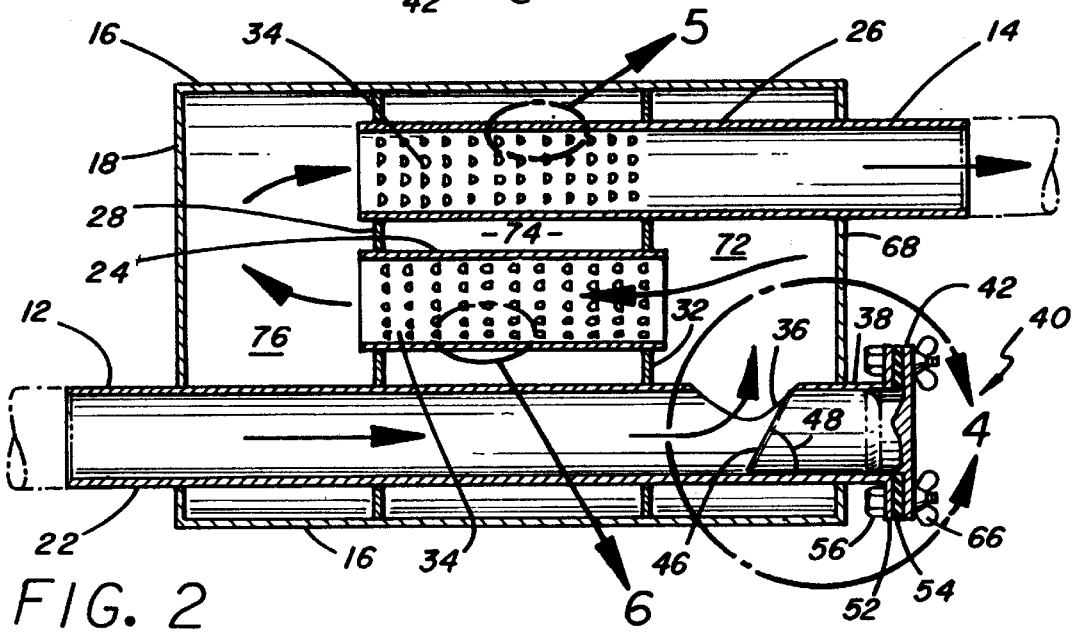
FIG. 2 is a sectional view along line 2—2 of FIG. 1.
Figure 3:
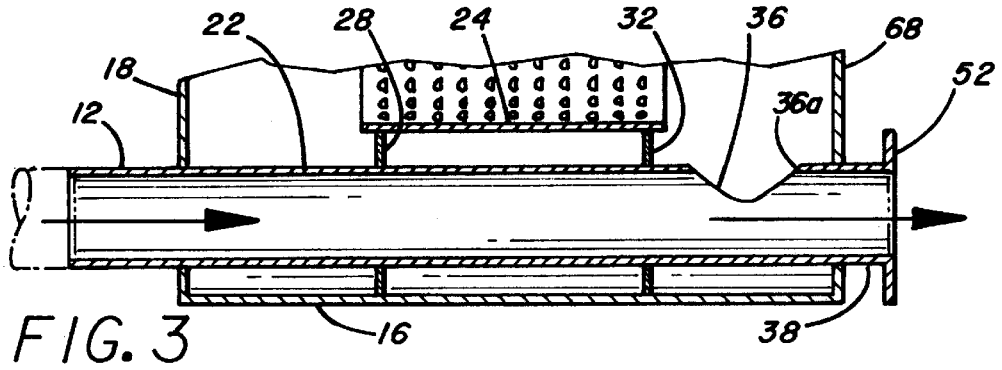
FIG. 3 is a partial sectional view of the bypass muffler in an unmuffled mode.
Figure 4:
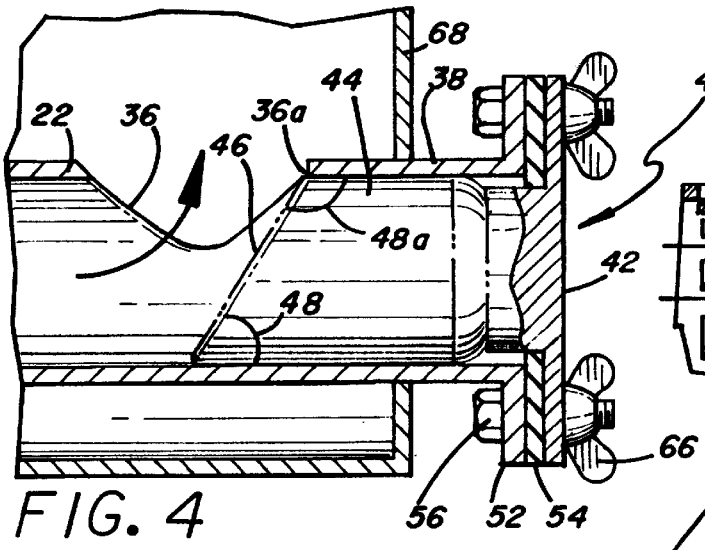
FIG. 4 is an enlarged partial sectional view of the area 4 of FIG. 2.

As shown best in FIG. 3, inlet 12 is connected to first outlet 38 by means of pipe 22. Near the outlet end 38 of pipe 22 is opening 36, which, when the flow diverter 40 is in place in the outlet 38 as shown in FIG. 2 and 4, diverts exhaust gas to flow from pipe 22 to other areas of the interior of the bypass muffler. However, and as shown best in FIG. 3, when flow diverter 40 is removed from outlet 38, virtually all of the exhaust gas from inlet 12 passes through pipe 22 and through outlet 38 to atmosphere. When flow diverter 40 is removed, the muffler is in what can be called an unmuffled mode which allows gases to be conducted to atmosphere without any significant resistance. It should be noted that pipe 22 is not provided with any silencing means.

Figure 5:
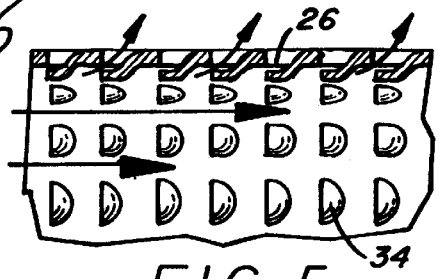
FIG. 5 is an enlarged partial sectional view of the area 5 of FIG. 2.
Figure 6:
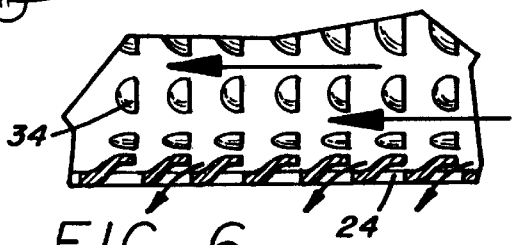
FIG. 6 is an enlarged partial sectional view of the area 6 of FIG. 2.
Figure 7:
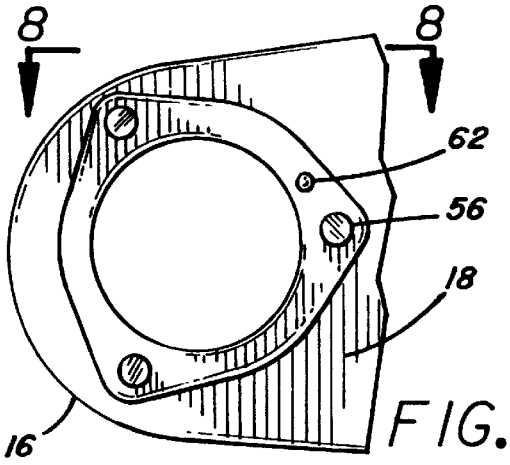
FIG. 7 is a partial sectional view of one end of the bypass muffler with the flow diverting means removed.
Figure 8:
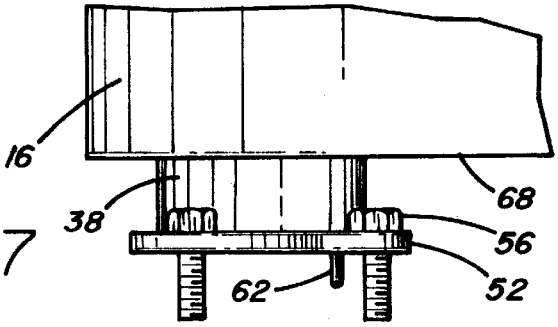
FIG. 8 is view taken a long line 8—8 of FIG. 7.
Figure 9:
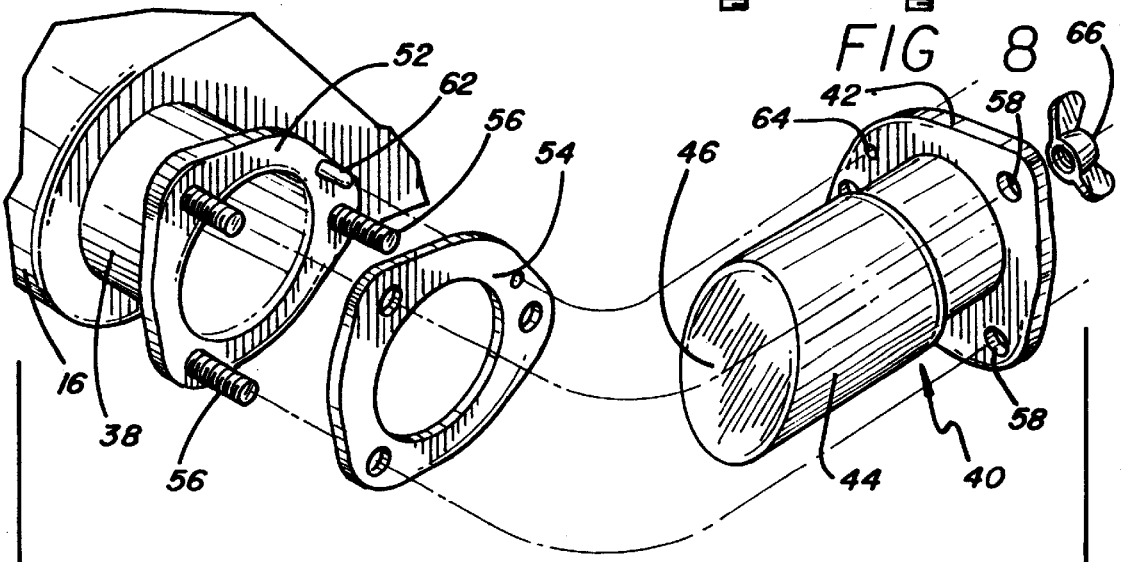
FIG. 9 is partial exploded view showing the flow diverting means and its incorporation into to the bypass muffler.

Referring again to FIG. 2, is again noted that when flow diverter 40 is in place, the exhaust gases are caused to flow from opening 36 of pipe 22 into chamber 72. The interior of muffler 10 includes 3 expansion chambers 72, 74, and 76. Chamber 72 is formed by baffle 32, a portion of shell 16 and endcap 68. Chamber 74 is formed by baffles 28 and 32 and again a portion of shell 16. Chamber 76 is formed by baffle 28, and endcap 18 and a portion of shell 16. Mounted within muffler 10 is center pipe 24 which passes through each of baffles 32 and 28. Pipe 24 is open at each end and communicates with chambers 72 and 76. As shown in FIG. 6, the walls of pipe 24 are provided with perforations 34 around its perimeter and allow the sound waves to communicate with chamber 74. Also, as shown in FIG. 2 is exhaust outlet pipe 26 which passes through baffles 28 and 32 and endwall 68. Pipe 26 is open at each end and communicates from chamber 76 to outlet 14. That portion of pipe 26 which lies within chamber 74 is provided with perforations 34, the detail of which is shown in FIG. 5. The balance of pipe 26 and outlet 14 is not perforated. An important feature of this invention, is the provision of means to efficiently divert the exhaust gas from the engine through the noise reducing components of the muffler when the muffler is in a muffled mode. As shown best in FIGS. 2 and 4, this is accomplished by means of a plug like flow diverter 40. The plug like body of diverter 40 is cylindrical in shape and of a diameter such that it closely fits within the interior wall of outlet 38 of pipe 22. One end of the diverter is provided with flange 42 which mates with flange 52 of outlet of 38 of pipe 22. As shown in FIG. 9, flange 52 of pipe 22 is provided with threaded bolts 56 and indexing pin 62. Flange 42 of diverter 40 is provided with openings 58 to receive bolts 56 and an additional opening 64 to receive indexing pin 62. Gasket 54 is positioned between flanges 52 and 62. Additionally, wing nuts 66 are used to securely fasten diverter 40 to the muffler assembly 10. As shown in FIGS. 4 and 9, the face 46 of the end of body 44 of diverter 40 opposite to flange end 42 is at an angle to the long axis of the diverter. Angle 48 and the length of body 44 are important in achieving maximum efficiency of the diverter when in place. As previously noted, the wall of pipe 22 is provided with opening 36 which, when diverter 40 is in place, allows exhaust gas to be directed through the opening, into expansion chamber 72 and from there throughout the balance of muffler assembly and finally out second outlet 14. Opening 36 should be of a diameter which is about the same as that of pipe 22 and positioned opposite to chamber 72. Not only is angle 48 and the length of body 44 important to achieving maximum efficiency of the diverter when in place, the position of the diverter in pipe 22 with respect to opening 36 is also important. Referring to FIG. 4, it will be seen that the apex 48*b* of angle 48*a* of plug 44 is in alignment with the edge 36*a* of opening 36, which edge 36*a* is closest to outlet 38. That is, the opening 36 is not blocked in any manner by plug 44. Acute angle 48 should range from about 59° to about 61° with about 60° being most preferred. This means that obtuse angle 48*a* will range from about 119° to about 121° with 120° preferred. Thus, it should be clear that the alignment or position of the diverter within opening 36 is very important. Because of this importance, an indexing pin 62 is provided on the face of flange 52, which indexing pin lines up with opening 64 of the flange on diverter 40, and insures that the appropriate alignment will always be in effect.

In operation, muffler 10 is mounted to the vehicle so that exhaust gas from the engine is directed into inlet 12. Exhaust gas outlet 14 can then be connected to a suitable exhaust pipe. When the vehicle is to be used for normal street driving, diverter 40 is mounted in outlet 38 as shown in FIGS. 2 and 4 effectively blocking any flow of gas from that outlet and diverting the exhaust gas through opening 36 of pipe 22. From opening 36, the exhaust gas passes through the various pipes within the interior of the muffler and exits from outlet 14 to an exhaust pipe in a muffled state. However, when the vehicle is to be used for racing, for example, the driver merely removes wing nuts 66 and removes diverter 40 from inlet 38. When the diverter is removed, virtually all the exhaust gas is conducted directly from the engine through exhaust gas outlet 38 and then to atmosphere.

I claim:

1. An exhaust gas muffler assembly for an internal combustion engine operable in both a muffled and unmuffled mode comprising:

a) an outer shell and pair of end caps for enclosing interior components of said assembly;

b) an inlet positioned in a first end cap for entry of exhaust gas from said engine to the interior of said assembly;

c) a first outlet positioned in a second end cap opposite to said inlet with a first pipe means connecting said inlet and first outlet allowing for the flow of exhaust gas from said engine to atmosphere in a basically unmuffled state;

d) flow diverting means removably positioned in said first outlet;

e) an opening in said first pipe means and so positioned in the wall of said first pipe means that when said flow diverting means is positioned in said first outlet, exhaust gas is diverted through said opening;

f) a second outlet positioned in said second end cap;

g) exhaust gas silencing means positioned within the interior of said assembly and operably connected between the opening in said first pipe means and said second outlet whereby exhaust gas is diverted through said silencing means when said flow diverting means is positioned in said first outlet.

2. The exhaust gas muffler assembly of claim 1 wherein one end of said flow diverter is provided with means for fastening said diverter to said assembly, with the face of the opposite end thereof being angled to its long axis so that exhaust gas is diverted through said opening in said first pipe means and then through said exhaust gas silencing means.

3. The exhaust gas assembly of claim 2 with said diverter having a diameter such that it closely fits within the interior wall of said first pipe means and wherein said diverter is angled so that the acute angle nearest said opening ranges from about 59° to about 61° and the obtuse angle nearest said opening ranges from about 119° to about 121°.

4. The exhaust gas assembly of claim 1 wherein said exhaust gas silencing means include a first chamber positioned adjacent to said opening, a second pipe means communicating from said first chamber to a second chamber, a third pipe means communicating from said second chamber to said second outlet, a third chamber surrounding said second pipe means and a portion of said third pipe means, with each of said second and third pipe means provided with sound reducing perforations.

5. The exhaust gas muffler assembly of claim 4 wherein one end of said flow diverter is provided with means for fastening said diverter to said assembly, with the face of the opposite end thereof being angled to its long axis so that exhaust gas is diverted through said opening in said first pipe means and then through said exhaust gas silencing means.

6. The exhaust gas assembly of claim 5 with said diverter having a diameter such that it closely fits within the interior wall of said first pipe means and wherein said diverter is angled so that the acute angle nearest said opening ranges from about 59° to about 61° and the obtuse angle nearest said opening ranges from about 119° to about 121°.

7. The exhaust gas assembly of claim 6 wherein said acute angle is about 60° and said obtuse angle is about 120°.

* * * * *